US009303966B1

(12) United States Patent
Lanterman et al.

(10) Patent No.: US 9,303,966 B1
(45) Date of Patent: Apr. 5, 2016

(54) SYMMETICAL INITIATION DISTRIBUTOR FOR USE IN EXPLOSIVE DETONATION TRAINS WITH AN OFFSET ORIENTATION

(71) Applicants: Daniel Lanterman, College Park, MD (US); Mary Sherlock, Waldorf, MD (US); George Shane Rolfe, Hollywood, MD (US); Taylor Young, Alexandria, VA (US)

(72) Inventors: Daniel Lanterman, College Park, MD (US); Mary Sherlock, Waldorf, MD (US); George Shane Rolfe, Hollywood, MD (US); Taylor Young, Alexandria, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/544,797

(22) Filed: Jan. 29, 2015

(51) Int. Cl.
*F42B 12/20* (2006.01)
*F42C 19/08* (2006.01)

(52) U.S. Cl.
CPC ..... *F42C 19/0838* (2013.01)

(58) Field of Classification Search
USPC ..... 102/275.11, 275.12, 499, 318, 200, 102/202.14
See application file for complete search history.

(56) References Cited

U.S. PATENT DOCUMENTS

| | | | | |
|---|---|---|---|---|
| 3,311,055 | A | 3/1967 | Stresau, Jr. et al. | |
| 3,430,563 | A | 3/1969 | Stresau | |
| 3,853,059 | A * | 12/1974 | Moe | F41H 11/02 102/493 |
| 3,896,731 | A | 7/1975 | Kilmer | |
| 3,980,019 | A * | 9/1976 | Anderson | F42C 9/14 102/265 |
| 4,145,972 | A | 3/1979 | Menz et al. | |
| 4,282,814 | A | 8/1981 | Menz et al. | |
| 4,475,461 | A * | 10/1984 | Durrell | F42C 19/0846 102/200 |

* cited by examiner

*Primary Examiner* — J. Woodrow Eldred
(74) *Attorney, Agent, or Firm* — Fredric J. Zimmerman

(57) ABSTRACT

An initiation distributor includes two plates coupled in a spaced-apart fashion. Each plate includes detonation transfer holes. A face of one plate has a depression and defined channels leading from the depression to the plate's detonation transfer holes, and has a detonation transfer port located in line with a plate's channels. The second plate has a detonation transfer port, and channels defined in its face that lead from the plate's detonation transfer port to its detonation transfer holes. Each of one plate's detonation transfer holes can be aligned with one of the second plate's detonation holes. A conduit couples the detonation transfer ports in the two plates with a pathway defined between the depression and each of the plates' detonation transfer holes. Explosive material fills the depression, all channels, all detonation transfer holes, all detonation transfer ports, and the conduit.

27 Claims, 3 Drawing Sheets

SYMMETICAL INITIATION DISTRIBUTOR FOR USE IN EXPLOSIVE DETONATION TRAINS WITH AN OFFSET ORIENTATION

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to control of the shock-to-detonation transition process within a fuze explosive detonation train. More particularly, the invention relates to a flanged bobbin apparatus used to provide controlled distribution of the detonation transfer to the fuze booster and subsequently to the main explosive charge of a warhead when the lead detonation is initiated from an offset orientation.

BACKGROUND OF THE INVENTION

Many existing general purpose bombs are designed to be detonated by a fuze initiation system that contains an explosive detonation train that typically contains a detonator and detonator lead that are located off-center (or offset) with respect to a hollow cylinder fuze booster charge in order to accommodate electrical cabling conduit that passes through the fuze booster. When used in combination with easily-detonated secondary main charge explosive fills, the offset initiation system of the explosive train is not typically a problem. However, more and more existing bomb and warhead designs are transitioning to insensitive main charge explosive fills in order to make the munition less responsive to unintended stimuli. Unfortunately, the complex geometry and multi-transient asymmetries created by an offset detonator system (as it will be referred to hereinafter) using an off center detonator lead complicates the shock-to-detonation transition process within the explosive detonation train, and impedes optimal detonation transfer to the main charge explosive fill. Furthermore, the offset detonator system leads to uncooperative detonation spreading behaviors, corner turning deficiencies, or other propagation problems that affect initiation and explosive performance in the main fill thereby rendering the explosive train ineffective for use with warheads filled with an insensitive explosive.

SUMMARY OF THE INVENTION

Accordingly, it is an object of the present invention to provide a shock-to-detonation transition distribution device for use in explosive trains with offset detonation leads.

Another object of the present invention is to provide an initiation distributor that works in perfect concert with the rest of the explosive detonation train to propagate a reliable detonation to an insensitive main explosive charge of a warhead.

Other objects and advantages of the present invention will become more obvious hereinafter in the specification and drawings.

In accordance with the present invention, an initiation distributor includes a first plate having a central hole and a plurality of first detonation transfer holes. The first detonation transfer holes are distributed about the first plate's central hole. The first plate has a first face with a depression well and channels defined therein that lead from the depression well to the first detonation transfer holes. The first plate also has a detonation transfer port located in line with one of the channels in the first plate. A second plate has a central hole and a plurality of second detonation transfer holes. The second detonation transfer holes are distributed about the second plate's central hole. The second plate has a detonation transfer port, and has a first face with channels defined therein that lead from the detonation transfer port in the second plate to the second detonation transfer holes. A coupler connects the central hole of the first plate to the central hole of the second plate, which may or may not be included in the present invention depending on manufacturing preference. In an exemplary embodiment, each of the first detonation transfer holes is aligned with a corresponding one of the second detonation transfer holes. Such alignment can be defined by the second detonation transfer holes being at mirror image locations with respect to the first detonation transfer holes, but the holes could also be indexed at a fixed angle relative to each other. A conduit couples the detonation transfer port in the first plate to the detonation port in the second plate. A resulting pathway is defined between the depression well and each of the first detonation transfer holes and each of the second detonation transfer holes. Continuous explosive material fills the depression well, the channels in the first plate, the first detonation transfer holes, the detonation transfer port in the first plate, the conduit, the detonation transfer port in the second plate, the channels in the second plate, and the second detonation transfer holes. A first covering is provided on the first face of the first plate, and a second covering is provided on the first face of the second plate.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
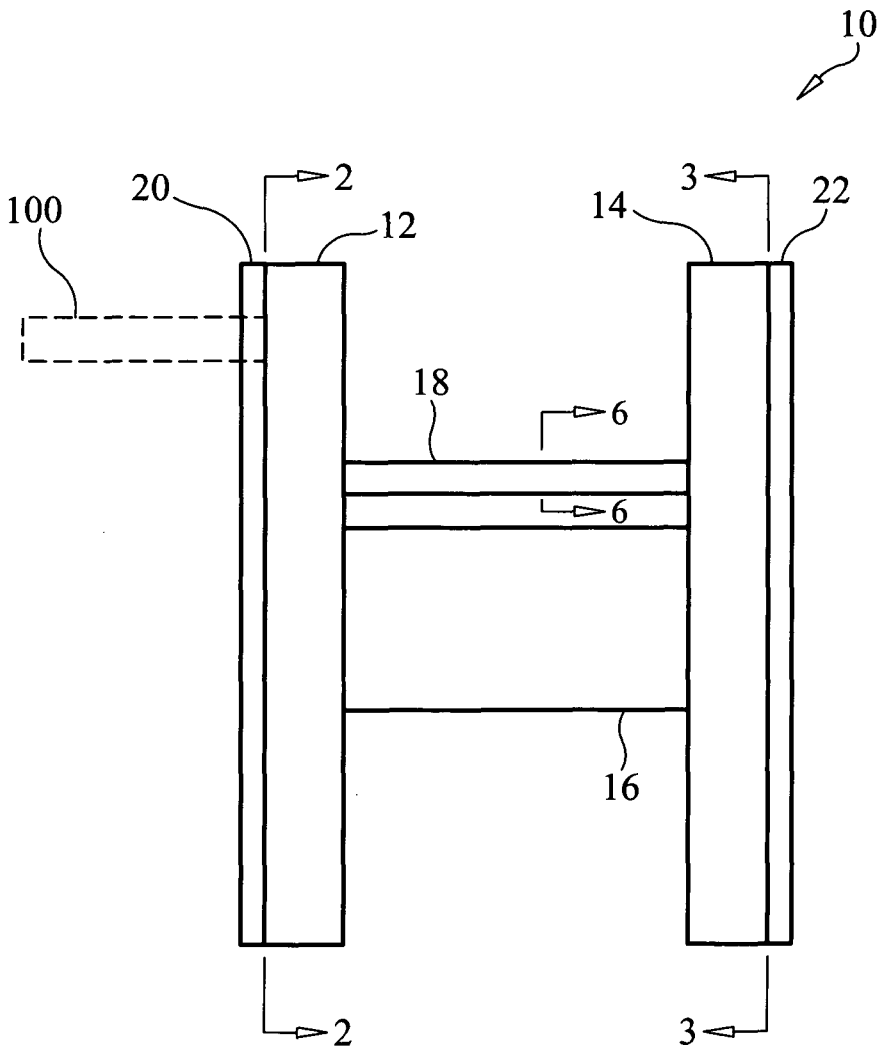
FIG. 1 is a side view of an initiation distributor in accordance with an exemplary embodiment of the present invention.
Figure 2:
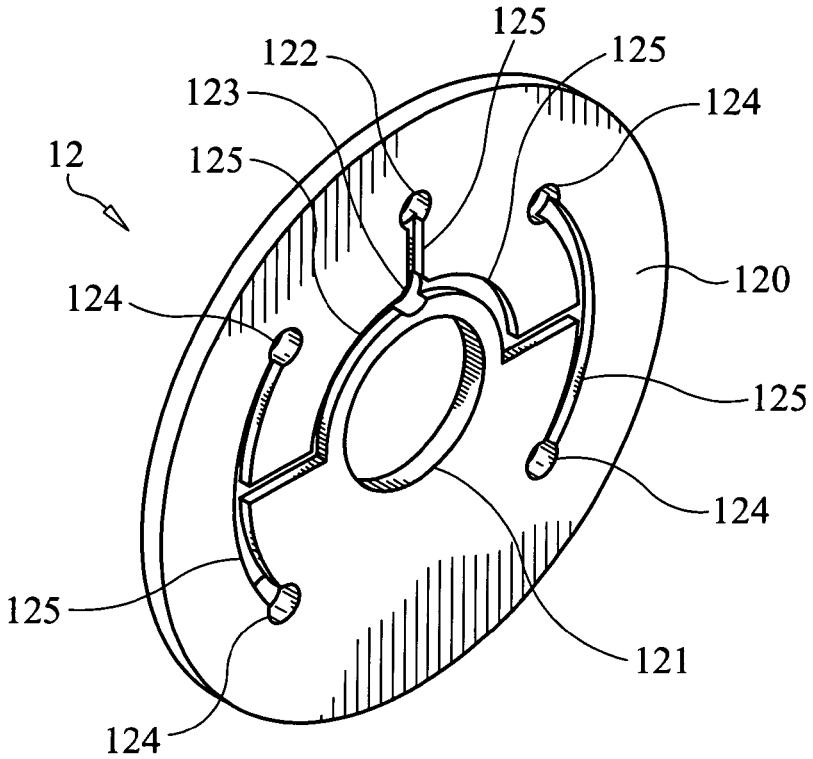
FIG. 2 is an isolated perspective view taken along 2-2 in FIG. 1 illustrating a first plate of the initiation distributor that is adjacent to an offset detonator system in accordance with an exemplary embodiment of the present invention.
Figure 3:
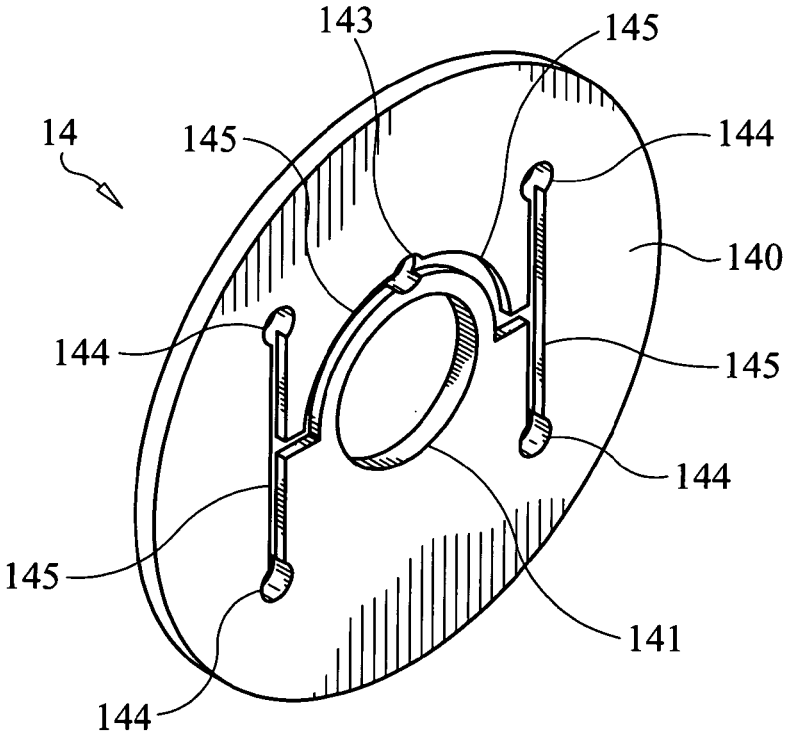
FIG. 3 is an isolated perspective view taken along 3-3 in FIG. 1 illustrating a second plate of the initiation distributor.
Figure 4:
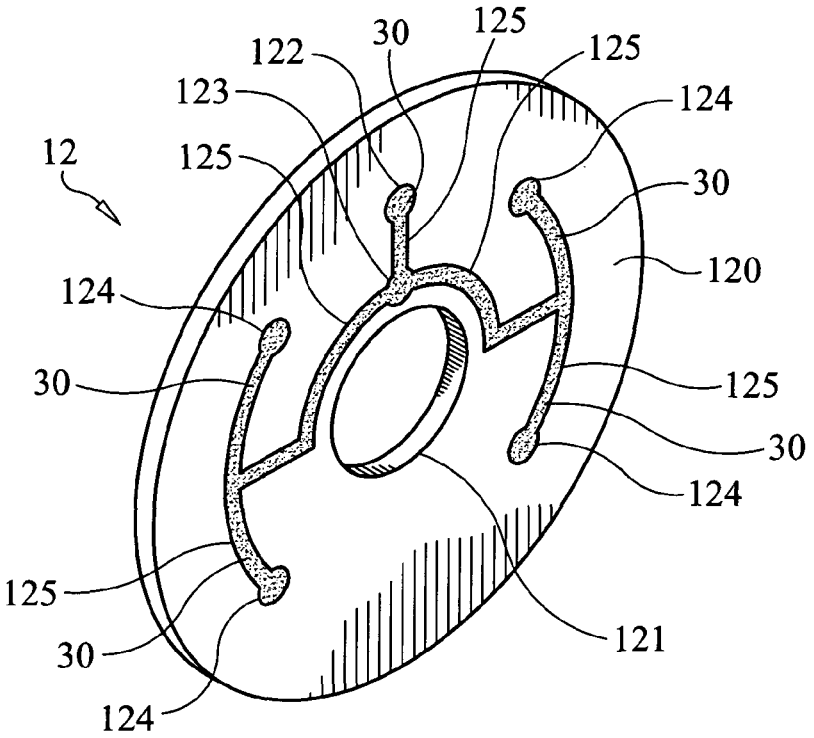
FIG. 4 is a perspective view of the first plate in FIG. 2 with continuous explosive material filling the plate's detonation well, channels, detonation transfer port, and detonation transfer holes.
Figure 5:
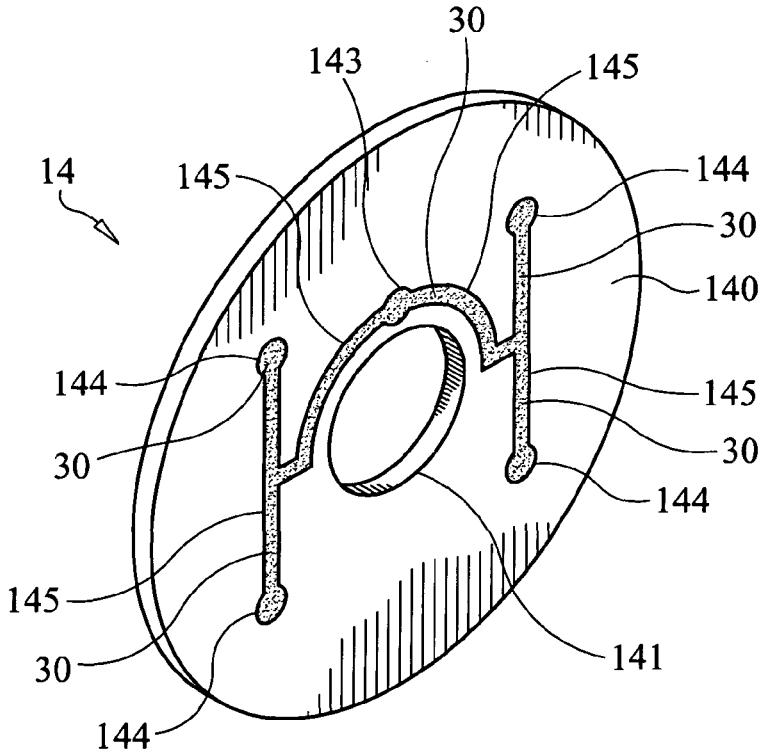
FIG. 5 is a perspective view of the second plate in FIG. 3 with continuous explosive material filling the plate's detonation transfer port, channels, and detonation transfer holes.

Referring now to the drawings, simultaneous reference will be made to FIGS. 1-6 where an initiation distributor in accordance with an exemplary embodiment of the present invention is shown and is referenced generally by numeral 10 in FIG. 1. Initiation distributor 10 is a bobbin-like apparatus having two spaced-apart flanges that will have a hollow cylinder explosive booster charge (not shown for clarity of illustration) disposed between them. In use, initiation distributor 10 will be positioned adjacent to an off center or offset detonation lead 100 (of an offset detonation system) that is shown in phantom lines to indicate that it is not part of the present invention and to show where the fuze detonator and detonator lead 100 assembly interfaces via a slight air gap to an explosively filled depression well 122 that will be explained further below. Briefly, initiation distributor 10 provides a novel structure for the controlled distribution and shock-to-detonation transfer from detonation lead 100 to a booster charge (not shown) disposed between the flanges of distributor 10. FIGS. 2 and 3 are isolated perspective views of the outward-facing faces of the two end plates or flanges of initiation distributor 10 without any explosive material filling portions thereof. FIGS. 4 and 5 are isolated perspective views of the two end plates or flanges of distributor 10 with continuous explosive material 30 filling portions thereof.

Initiation distributor 10 includes end plates 12 and 14 coupled to one another by a central hollow spool or coupler 16. As is known in the art, coupler 16 defines an open-ended cylindrical region through which an electrical communication conduit (not shown or part of the present invention) passes for purpose of controlling bomb arming operations. Plate 12 is positioned adjacent detonation lead 100 and plate 14 is spaced-apart from plate 12 by coupler 16. Running parallel to coupler 16 and between plates 12/14 is a hollow and open-ended tube or conduit 18 whose function will be described later herein. The above-elements of distributor 10 are made from non-explosive material(s) and could be a monolithic structure or constructed as an assembly without departing from the scope of the present invention. Depending on the method of manufacture, coupler 16 may be eliminated or replaced by spokes, or the like, to position, mechanically, the plates 12/14 relative to each other. Initiation distributor 10 also includes a non-explosive material protective cover or seal 20 covering an outward-facing face of plate 12, and a non-explosive material protective cover or seal 22 covering an outward-facing face of plate 14.

In general, plates 12/14 and conduit 18 define a number of detonation pathways between detonation lead 100 and a donut-shaped booster charge material (not shown) that will be disposed between plates 12/14. Plates 12/14 may be circular and equal in diameter as shown, but this configuration is not a requirement of the present invention. Referring now to FIG. 2, the outward-facing face 120 of plate 12 has a central hole 121 there through aligned with coupler 16. Face 120 also has a well or depression 122 defined therein positioned to be adjacent to detonation lead 100 when distributor 10 is in use. A detonation transfer port 123 extends through plate 12 and is aligned with one open end of conduit 18. A plurality of detonation transfer holes 124 also extend through plate 12. Four detonation transfer holes 124 are illustrated as an exemplary embodiment, but more or fewer holes could be used without departing from the scope of the present invention. Detonation transfer holes 124 can be evenly distributed about center hole 121 when distributor 10 is to provide an axisymmetric detonation of a booster charge as will be explained later below. Channel regions 125 are also defined in face 120 to define pathways between depression well 122 and each of detonation transfer holes 124. For an axisymmetric detonation, each such pathway should be approximately the same length and thickness. Detonation transfer port 123 is located in line with one of channel regions 125. FIG. 4 illustrates plate 12 with each of depression well 122, detonation transfer port 123, detonation transfer holes 124, and channel regions 125 filled with a continuous explosive material 30.

Figure 6:
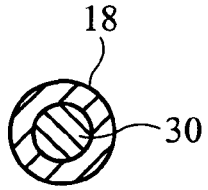
FIG. 6 is a cross-sectional view taken along line 6-6 in FIG. 1 illustrating the continuous explosive material-filled conduit required for detonation transfer from the first plate to the second plate.

Referring now to FIG. 3, the outward-facing face 140 of plate 14 has a central hole 141 there through aligned with coupler 16. Face 140 also has a detonation transfer port 143 extending through plate 14 and aligned with the opposing open end of conduit 18. A plurality of detonation transfer holes 144 also extend through plate 14. For an axisymmetric detonation, the number of detonation transfer holes 144 matches the number of detonation transfer holes 124 with each of holes 144 being located in a mirror-image location with respect to a corresponding one of holes 124. Similar to channel regions 125, channel regions 145 are also defined in face 140 to define pathways between detonation transfer port 143 and each of detonation transfer holes 144. Furthermore, since conduit 18 defines a pathway between detonation transfer ports 123 and 143, a pathway is also defined between depression well 122 in plate 12 and each detonation transfer hole 144 in plate 14. FIG. 5 illustrates plate 14 with each of detonation transfer port 143, detonation transfer holes 144, and channel regions 145 filled with continuous explosive material 30. FIG. 6 illustrates a cross-section of conduit 18 that is similarly filled with continuous explosive material 30 to form a continuous explosive material 30 pathway network that links channel regions 125/145.

For the axisymmetric detonation configuration of initiation distributor 10, approximately equal-length pathways should be defined between depression well 122 and each of detonation transfer holes 124 and each of detonation transfer holes 144. To do this, channel regions 145 must be configured to account for the length of conduit 18 which carries the explosive initiation train from plate 12 to plate 14 relative to the length of channel regions 125.

The advantages of the present invention are numerous. The initiation distributor is a simple apparatus that defines multiple point initiation pathways from an offset detonator system to both sides of a booster change. Upon firing, the detonation energy from the initiation distributor 10 propagates from each flange plate inner surface towards the center of the booster charge, where the detonation waves collide creating an implosion for a greater energy release rate. Thus, an exemplary embodiment of the present invention is readily adapted to satisfy shock-to-detonation transfer challenges posed by today's insensitive munition main charge explosive fill requirements. Detonation transfer hole placements, pathway lengths, and plate sizes may be adjusted to provide axisymmetric detonation conditions (as in the illustrated embodiment), or other specific detonation wave shaping schemes (e.g., asymmetrical, time-delayed, directionally-controlled waves, etc.) depending on the requirements of the application.

Although the invention has been described relative to a specific embodiment thereof, there are numerous variations and modifications that will be readily apparent to those skilled in the art in light of the above teachings. For example, detonation transfer holes in plates 12 and 14 may be positioned at non-mirror-image locations to enhance or otherwise alter the detonation wave interaction between the two plates. Another option is to have one detonation path length defined for plate 12 and a different detonation path length defined for plate 14 to thereby provide a delay in the detonation at one plate relative to the other plate. The detonation transfer holes may be located anywhere on the plates without departing from the scope of the present invention. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. An initiation distributor, comprising:

a first plate including a central hole and a plurality of first detonation transfer holes extending therethrough, said first detonation transfer holes distributed about said central hole of said first plate, said first plate includes a first face with a depression and channels defined therein that lead from said depression to said first detonation transfer holes, and said first plate further includes a detonation transfer port passing therethrough and located in line with one of said channels in said first plate;

a second plate including a central hole and a plurality of second detonation transfer holes extending therethrough, said second detonation transfer holes distributed about said central hole of said second plate, said second plate includes a detonation transfer port passing therethrough, and said second plate includes a first face with channels defined therein that lead from said detonation transfer port in said second plate to said second detonation transfer holes;

a coupler coupling said central hole of said first plate to said central hole of said second plate, wherein each of said first detonation transfer holes is aligned with a corresponding one of said second detonation transfer holes;

a conduit coupling said detonation transfer port in said first plate to said detonation port in said second plate, wherein a pathway is defined between said depression and each of said first detonation transfer holes and each of said second detonation transfer holes;

explosive material filling said depression, said channels in said first plate, said first detonation transfer holes, said detonation transfer port in said first plate, said conduit, said detonation transfer port in said second plate, said channels in said second plate, and said second detonation transfer holes;

a first covering on said first face of said first plate; and a second covering on said first face of said second plate.

2. The initiation distributor as in claim 1, wherein each said pathway is approximately the same length.

3. The initiation distributor as in claim 1, wherein said first detonation transfer holes are evenly distributed about said central hole in said first plate.

4. The initiation distributor as in claim 1, wherein said conduit is parallel to said coupler.

5. The initiation distributor as in claim 1, wherein said first face of said first plate and said first face of said second plate face away from one another.

6. The initiation distributor as in claim 1, wherein said first plate and said second plate are circular and are equal in diameter.

7. The initiation distributor as in claim 1, wherein said coupler is cylindrical.

8. An initiation distributor, comprising:

a first plate including a central hole and a plurality of first detonation transfer holes extending therethrough, said first detonation transfer holes distributed evenly about said central hole of said first plate, said first plate includes a first face with a depression and channels defined therein that lead from said depression to said first detonation transfer holes, and said first plate further includes a detonation transfer port passing therethrough and located in line with one of said channels in said first plate;

a second plate including a central hole and a plurality of second detonation transfer holes extending therethrough, said second detonation transfer holes distributed evenly about said central hole of said second plate, said second plate includes a detonation transfer port passing therethrough, and said second plate includes a first face with channels defined therein that lead from said detonation transfer port in said second plate to said second detonation transfer holes;

a first conduit coupling said central hole of said first plate to said central hole of said second plate, wherein each of said first detonation transfer holes is aligned in mirror-image fashion with a corresponding one of said second detonation transfer holes;

a second conduit coupling said detonation transfer port in said first plate to said detonation port in said second plate, wherein an equal-length pathway is defined between said depression and each of said first detonation transfer holes and each of said second detonation transfer holes;

explosive material filling said depression, said channels in said first plate, said first detonation transfer holes, said detonation transfer port in said first plate, said second conduit, said detonation transfer port in said second plate, said channels in said second plate, and said second detonation transfer holes;

a first covering being situated on said first face of said first plate; and a second covering being situated on said first face of said second plate.

9. The initiation distributor as in claim 8, wherein said second conduit is parallel to said first conduit.

10. The initiation distributor as in claim 8, wherein said first face of said first plate and said first face of said second plate face away from one another.

11. The initiation distributor as in claim 8, wherein said first plate and said second plate are circular and are equal in diameter.

12. The initiation distributor as in claim 8, wherein said first conduit is cylindrical.

13. An initiation distributor, comprising:

a bobbin including a first flange and second flange being coupled in a spaced-apart relationship by a hollow spool, wherein said first flange includes a plurality of first detonation transfer holes extending therethrough, said first flange includes a first face with a depression and channels defined therein that lead from said depression to said first detonation transfer holes, said first flange further includes a detonation transfer port passing therethrough and located in line with one of said channels in said first flange, wherein said second flange includes a plurality of second detonation transfer holes extending therethrough, said second flange includes a detonation transfer port passing therethrough, and said second flange includes a first face with channels defined therein that lead from said detonation transfer port in said second flange to said second detonation transfer holes, and wherein each of said first detonation transfer holes aligned in mirror-image fashion with a corresponding one of said second detonation transfer holes;

a conduit coupling said detonation transfer port in said first flange to said detonation transfer port in said second flange, wherein a pathway is defined between said depression and each of said first detonation transfer holes and each of said second detonation transfer holes;

explosive material filling said depression, said channels in said first flange, said first detonation transfer holes, said detonation transfer port in said first flange, said second conduit, said detonation transfer port in said second flange, said channels in said second flange, and said second detonation transfer holes;

a first covering being situated on said first face of said first flange; and a second covering being situated on said first face of said second flange.

14. The initiation distributor as in claim 13, wherein each said pathway is approximately the same length.

15. The initiation distributor as in claim 13, wherein said first detonation transfer holes are evenly distributed about said first flange.

16. The initiation distributor as in claim 13, wherein said conduit is parallel to said hollow spool.

17. The initiation distributor as in claim 13, wherein said first face of said first flange and said first face of said second flange face away from one another.

18. The initiation distributor as in claim 13, wherein said first flange and said second flange are circular and are equal in diameter.

19. The initiation distributor as in claim 13, wherein said hollow spool is cylindrical.

20. An initiation distributor for interfacing with an offset detonator system having an off center detonator lead, comprising:

a first plate including a central hole and a plurality of first detonation transfer holes extending therethrough, said first detonation transfer holes distributed about said central hole of said first plate, said first plate includes a first face with a depression well adapted to oppose the off center detonator lead, said first plate includes channels defined therein that lead from said depression well to said first detonation transfer holes, and said first plate further includes a detonation transfer port passing therethrough and located in line with one of said channels in said first plate;

a second plate including a central hole and a plurality of second detonation transfer holes extending therethrough, said second detonation transfer holes distributed about said central hole of said second plate, said second plate includes a detonation transfer port to pass therethrough, and said second plate includes a first face with channels defined therein that lead from said detonation transfer port in said second plate to said second detonation transfer holes;

a coupling connecting said central hole of said first plate to said central hole of said second plate;

a conduit coupling said detonation transfer port in said first plate to said detonation transfer port in said second plate, wherein a continuous pathway is defined between said depression well and each of said first detonation transfer holes and each of said second detonation transfer holes;

continuous explosive material filling said depression well, said channels in said first plate, said first detonation transfer holes, said detonation transfer port in said first plate, said conduit, said detonation transfer port in said second plate, said channels in said second plate, and said second detonation transfer holes;

a first protective covering being situated on said first face of said first plate; and a second protective covering being situated on said first face of said second plate, wherein, upon firing of the off center detonator lead, a detonation front is generated in said explosive material at said depression well, said detonation front propagates along said explosive material in said channels in said first plate, said detonation transfer holes in said first plate, said conduit, said channels in said second plate, and said second detonation transfer holes.

21. The initiation distributor as in claim 20, wherein each said pathway is approximately the same length.

22. The initiation distributor as in claim 20, wherein said first detonation transfer holes are evenly distributed about said central hole in said first plate.

23. The initiation distributor as in claim 20, wherein said conduit is parallel to said coupler.

24. The initiation distributor as in claim 20, wherein said first face of said first plate and said first face of said second plate face away from one another.

25. The initiation distributor as in claim 20, wherein said first detonation transfer holes and said second detonation transfer holes are in a mirror-image alignment.

26. The initiation distributor as in claim 20, wherein said first detonation transfer holes and said second detonation transfer holes are in a non-mirror-image alignment.

27. The initiation distributor as in claim 20, wherein said pathway between said depression well and each of said first detonation transfer holes comprises a first length, wherein said pathway between said depression well and each of said second detonation transfer holes comprises a second length, and wherein said first length is different than said second length.

* * * * *